United States Patent [19]

Bourdier et al.

[11] Patent Number: 4,842,523

[45] Date of Patent: Jun. 27, 1989

[54] MAKEUP METHOD AND DEVICE

[76] Inventors: Jean-Claude Bourdier, 17, Place des Vosges, F-75004 Paris; Frederic G. Bourdier; Brigitte E. Bourdier, both of 8, rue Francaise, F-75002 Paris; Claude H. Bourdier nee Serre, 17, Place des Vosges, F-75004 Paris, all of France

[21] Appl. No.: 54,275

[22] PCT Filed: Sep. 16, 1986

[86] PCT No.: PCT/FR86/00312

§ 371 Date: May 6, 1987

§ 102(e) Date: May 6, 1987

[87] PCT Pub. No.: WO87/01567

PCT Pub. Date: Mar. 26, 1987

[30] Foreign Application Priority Data

Sep. 16, 1985 [FR] France ..... 8513667

[51] Int. Cl.[4] ..... A45D 44/00

[52] U.S. Cl. ..... 434/371; 434/377; 132/200

[58] Field of Search ..... 132/5, 9; 434/84, 99, 434/100, 371, 377

[56] References Cited

U.S. PATENT DOCUMENTS

| | | | |
|---|---|---|---|
| 2,168,352 | 8/1939 | Lawry | 434/150 X |
| 2,257,981 | 10/1941 | Scott | 434/371 X |
| 2,293,271 | 8/1942 | Von Knauf | 434/371 |
| 2,808,757 | 10/1957 | Scott | 434/371 |
| 3,339,453 | 9/1967 | Udich | 434/94 |
| 4,232,334 | 11/1980 | Byron | 434/377 X |

FOREIGN PATENT DOCUMENTS 1297337 5/1962 France .

*Primary Examiner*—A. Michael Chambers
*Assistant Examiner*—John C. Fox
*Attorney, Agent, or Firm*—Charles E. Baxley

[57] ABSTRACT

According to the method, a portrait of the client is projected onto a medium and is made up, said medium being suitable for receiving cosmetics such as makeup and cream and the references of the cosmetics used to perform the makeup are marked on a chart. Applications: the customer takes the medium and the chart away with her or him and can easily reproduce the style of makeup as often as she or he desires.

5 Claims, 2 Drawing Sheets

MAKEUP METHOD AND DEVICE

The present invention relates to a method and to a device for enabling a client to select a given style of facial makeup together with the cosmetics necessary for preparing it, a device for performing the method, together with projection media and makeup charts obtained in accordance with the method.

It is known that a style of makeup lends itself to numerous variants enabling the appearance of the face to be modified practically at will, in particular as a function of lighting. Thus, daytime makeup is generally different, for example, from evening makeup.

The customer finds a large number of substances available, and she chooses between them on criteria which are generally arbitrary. On some occasions she may call on a beautician to make her up in a given style, however she experiences great difficulty in subsequently reproducing the same style of makeup at home.

An object of the present invention is to enable a client to use the services of a consulting beautician or makeup artist to provide a personalized style of makeup which the client can reproduce very simply.

Another object of the invention is a method for guiding the client in selecting the cosmetics most adapted to the conformation of her face, to her complexion, to the characteristics of her skin, and to the color of her eyes and her hair Yet another object of the invention is a simple device for genuinely training the client in making herself up in a suitable style.

The invention is based on the fact that a style of makeup requires information on cosmetics and their exact tints, and on the configuration of the areas to be made up.

French Patent No. 1,297,337 has already proposed presenting a style of makeup in front of the client on a pre-printed sketch roughly representative of the shape of the customer's face, by directly applying makeup to desired locations on the sketch. However, selecting a predetermined type of face eliminates certain important aspects of a face's personality, and this method runs the risk of leading to a sort of uniformity in styles of makeup.

U.S. Pat. 3,339,453 describes a method of pre-selecting hairstyles. To this end, a photograph of the client with her hair masked out is projected simultaneously with a photograph of the hairstyle to form a composite image. This method requires cutting or masking work to be performed on a picture which has been taken of the client and is relatively long. Also, it is not possible in practice to obtain an exact reproduction of the tints of makeup by projecting a photograph onto a medium. Also, a style of makeup is constituted by a multitude of colored areas so that it is not possible to provide an accurately fitting superposition.

It might have been thought that a makeup simulating device could be constituted by a set of suitably disposed mirrors. However, since simulating a particular style of makeup requires a relatively long period of time, it is not possible to keep the client still for long enough to perform the precision work required to provide a given style of makeup.

A device for simulating makeup is also known which makes use of a television picture with an image being stored and displayed on a screen. However, the selection of makeup tints can only be performed on an image obtained by transmission and this is not satisfactory with regards to color rendition. In addition, such devices are expensive and require highly specialized personnel to maintain them.

According to the present invention, the makeup method is characterized in that it consists in forming an image of the face of a client on an opaque medium suitable for receiving makeup and for reproducing the exact nuances thereof as when applied to the skin, and in applying makeup to said projection at locations suitable for providing a personalized style of makeup which the client can then reproduce easily.

The medium thus simultaneously acts as a projection surface and as a makeup surface. It is essential, in accordance with the invention, to work by reflection since it is reflection and not transmission which is applicable to ordinary makeup. Thus, the client may leave the makeup location taking with her a medium showing the configuration of the makeup and the tints thereof, and she can easily reproduce the style of makeup specifically created for her.

According to the invention, work is performed directly with the cosmetics themselves rather than with colors which are merely close thereto. In addition, by reversing the image obtained from the initial shot, a specular image of the client's face is obtained on the support, i.e. an image of her face as seen in a mirror.

In accordance with another characteristic of the method, the image of the face is obtained by projecting an overexposed slide onto a suitable medium.

Slides may now be obtained by taking a picture with a "Polaroid" (Registered Trademark) camera. This makes it immediately possible to project the contours of a face which serve as landmarks for applying makeup, cream, etc. Advantageously, the picture is taken in the form of a slide or "diapositive". However, it is possible to use an image on an opaque medium and to project it by means of an Episcope type apparatus. Likewise, the method may be performed from an image taken from a television camera tube, provided that the image is projected onto a medium in accordance with the invention.

When a client goes into a shop, she is generally already made up and overexposure is a means for avoiding the need for her to take her makeup off before operations begin. Overexposure serves, to some extent, to wipe out the makeup being worn so that new makeup can be provided on the medium. However, tests have shown that a normal image may be projected so long as the client is not too heavily made up to begin with, and providing the light intensity of the projector is reduced. This is because the purpose of the projection is solely to inform the beautician on the topology of the various areas to be covered in makeup.

When the projection is switched off, all that remains on the sheet is the disposition of the colors on the face together with their distribution. The makeup artist can easily sketch in the contours of the client's face. It might have been thought that the makeup could be performed on a photographic medium, however the nature of these media prevent the desired result from being obtained. A suitable medium means a medium of plastic material or the like which is flesh colored (or optionally a neutral gray, for eample, if the blocking-out effect due to overexposure is to be accentuated), with the medium having a surface state such that makeup may be applied thereto under the same conditions as to skin.

However, it is preferable for the projection and makeup medium to be a composite medium comprising a rigid base, e.g. made of card, and an active top surface constituted by a slightly granular rubberized top suitable for absorbing the water and the grease generally contained in makeup.

Whereas previously the beautician applied makeup directly to the client's face, in accordance with the invention the beautician makes up a fleeting reproduction of the client's face and only the makeup artwork remains permanently on the medium.

According to another characteristic of the invention, the projection is made onto a medium which includes a chart of available cosmetics and colors.

When making up a portion of the face projected onto the medium-constituting sheet, for example the lips, the beautician copies the lipstick used in the form of a sample line and a reference onto a region of the medium which constitutes a palette, which region may be the bottom edge of the sheet onto which the portrait is projected, or else a sheet adjacent to the medium.

In a second implementation, the makeup method is characterized in that it consists in:

taking two successive photographs of the client's face, with the second portrait being overexposed;

projecting both portraits side-by-side, with the over-exposed portrait being filtered so as to provide the same tints; and making up the over-exposed portrait.

The first portrait serves as a permanent reference while performing work on the over-exposed portrait. However, when projecting a single portrait, it is still possible to obtain a reference portrait at any moment by putting a sheet of white card over the projection plane, for example.

The invention also relates to a device for performing the method and to makeup plates obtained using the method;

Other characteristics and advantages of the invention appear from the following description of a particular implementation which is given solely by way of non-limiting example with reference to the drawings, in which.

Figure 1:
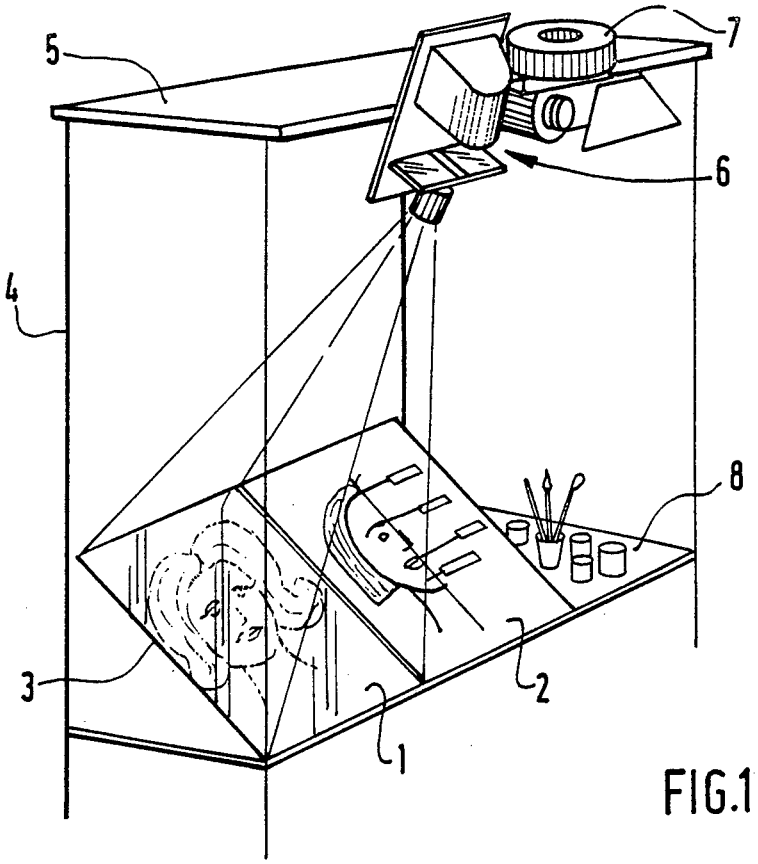
FIG. 1 is a perspective view of a makeup booth enabling the method in accordance with the invention to be performed

FIG. 1 shows a makeup booth 4 which is closed by a roof 5 carrying a projector 6 which may be accompanied by a carrousel of slides 7. A screen is disposed facing the projector 6 and is constituted by a left-hand (in FIG. 1) portion 1 of a medium, said portion 1 being optionally connected to a right-hand portion 2. The two sheets 1 and 2 of the medium are disposed on a desk 3 orthogonal to the axis of the lamp 6. A table 8 is provided to the right of the desk 3 on which the beautician can put a set of cosmetics suitable for providing different makeups. An additional projector or a portion of the beam from the projecter 6 illuminates the sheet 2 with a daylight type of illumination. In accordance with the invention real cosmetics are always used and they are used under natural light.

The presence of a booth 4 is justified by the need to have a zone of reduced illumination so that the projection can be observed under good conditions. However, it is naturally possible to work directly in a room which is dim enough.

Figure 2:
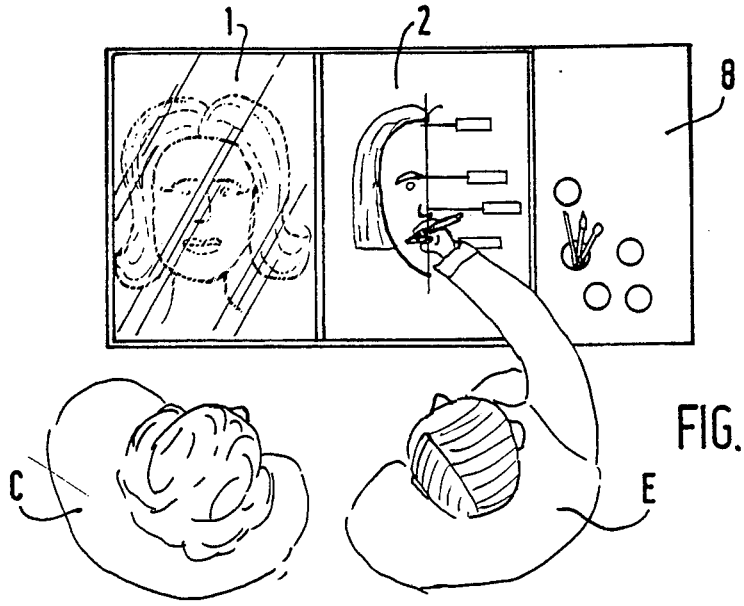
FIG. 2 is a diagrammatic plan view showing making up taking place.

As can be seen in FIG. 2, the client C sits down next to the beautician E while the work is taking place. This begins with making up the plate 1 on which the over-exposed portrait of the client is projected, and the client may speak with the adviser while the plate 1 is being made up.

If the result is unsatisfactory, the portion 1 and/or 2 of the medium may be thrown away and makeup may be started over until mutual satisfaction is achieved. The client can thus follow the process of making up as it takes place and the cosmetics which are used. It is also possible to use the carrousel 7 to project an example face similar to the face of the client onto the plate 2. A potentiometer or a triac dimmer can be used to adjust the brightness of the projection. In this case, the beautician can instruct the client on makeup suitable for her case and show her how to remedy possible defects.

Figure 3:
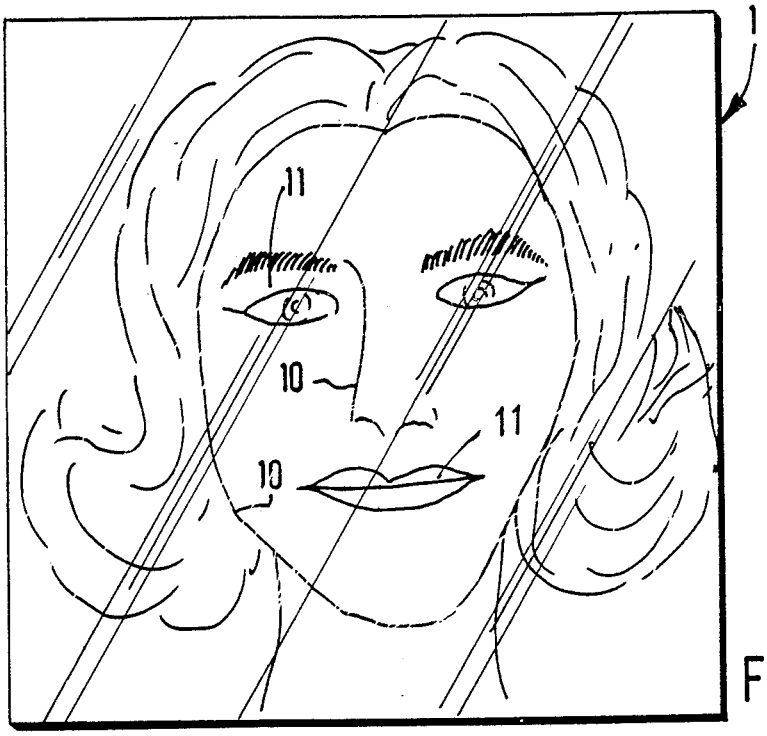
FIG. 3 is a view of the left-hand side of the working medium for receiving a projected portrait.

This brings us to the disposition of FIG. 3 where the projected contours 10 of the client's face are shown in broken lines while the makeup zones 11 are shown in solid lines.

Figure 4:
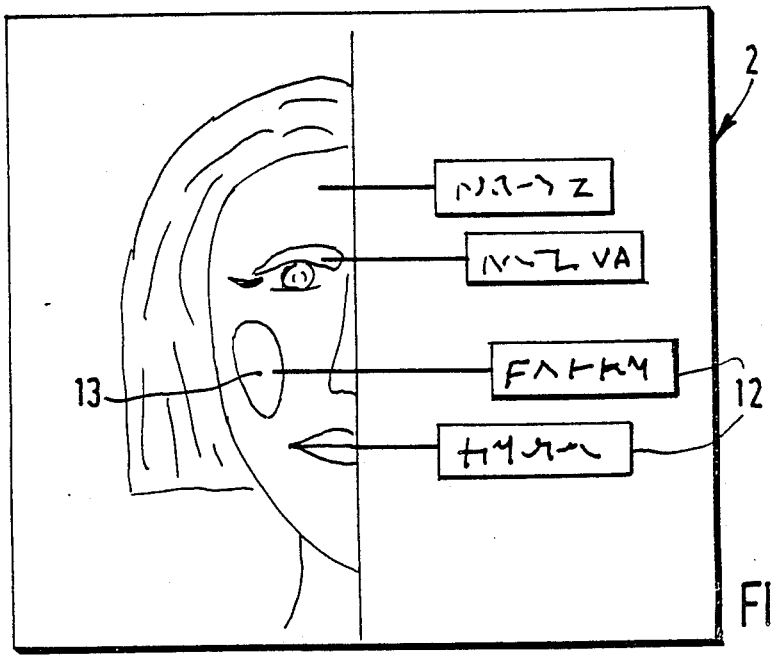
FIG. 4 is a view of the palette or chart of the cosmetics used and the locations on which they may be applied.

Once this result has been achieved, the beautician E marks the names and references of the cosmetics used to produce a specific style of makeup onto a pre-printed chart of palette 2 as shown in FIG. 4, or else merely marks boxes provided for the purpose. On FIG. 4, the sheet or sheet portion 2 has a pre-printed drawing of half of a woman's face. Zones 13 which are commonly made up, such as the lips for example, are also pre-printed thereon together with reference rectangles 12 connected to the makeup zones by arrows. The beautician marks the names and any other desirable references of the cosmetics used in the boxes 12. The client takes the sheets 1 and 2 home as a reminder both of the cosmetics used and of their dispositions on her face. She thus knows which cosmetics to use and how to use them in order to reconstitute a style of makeup designed by the beautician.

In another implementation of the invention (not shown), instead of using a single over-exposed image, a normal image is used simultaneously. These two images are projected side-by-side with a filter being disposed on the light path of the over-exposed image in order to obtain the same light density in the projection plane for both images. It is also possible for simplification purposes to project only one portrait image and to perform the makeup thereon. The client can thus compare her current makeup with the makeup she will obtain using the suggested cosmetics organized in a configuration which is analogous to that of FIG. 3 in the preceding example. Naturally, in this implementation, the sheet 2 no longer exists since it is replaced by the current portrait. The beautician therefore marks the names of the cosmetics used on the sheet 1 and this is the sheet which is used as a reminder, as before. It should be understood that, although a female client has been referred to in the specification, the invention also applies to males and their cosmetics.

What is claimed is:

1. A method for making up a client characterized in that the method consists of projecting an image of the client's face onto a projection surface which has an opaque medium (1) thereon, said medium being suitable for receiving makeup and for reproducing exact nuances thereof as when applied to skin and of disposing makeup on said projection surface in suitable locations to achieve a desired style of makeup.

2. A method according to claim 1, characterized further in that the image of the client's face is obtained by projecting a slide onto the opaque medium (1), which slide produces only main features (10) of the client's face.

3. A method according to claim 1, characterized further in that a chart (2) is annexed to the projection surface (1), with the chart enabling information relating to the cosmetics to be written thereon and enabling samples of the cosmetics to be applied thereto.

4. A method according to claim 3, characterized further in that the chart (2) has a preprinted outline of a client's face on which zones (13) to be made up are marked together with a list of the cosmetics available for providing a desired style of makeup.

5. A makeup method according to claim 1, characterized further in that it consists of:

taking two successive photographic portraits of the client's face, with the second of the portraits being overexposed;

projecting both portraits side by side, with the overexposed portrait being filtered in such a manner as to provide the same tones;

making up the overexposed portrait;

making indications about the cosmetics used the projection surface.

* * * * *